US008528534B2

(12) United States Patent
McPherson

(10) Patent No.: US 8,528,534 B2
(45) Date of Patent: Sep. 10, 2013

(54) ARCHERY BOW AXLE

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 204 days.

(21) Appl. No.: 12/620,435

(22) Filed: Nov. 17, 2009

(65) Prior Publication Data

US 2010/0132686 A1 Jun. 3, 2010

Related U.S. Application Data

(60) Provisional application No. 61/115,489, filed on Nov. 17, 2008.

(51) Int. Cl.
*F41B 7/00* (2006.01)

(52) U.S. Cl.
USPC ..... 124/25.6; 124/86

(58) Field of Classification Search
USPC ..... 124/25.6, 86, 88; 292/305; 16/93 R; 411/360, 361, 372.5, 372.6, 373, 362, 508, 411/509, 510; 403/285
See application file for complete search history.

(56) References Cited

U.S. PATENT DOCUMENTS

| | | | | | |
|---|---|---|---|---|---|
| 1,348,767 | A * | 8/1920 | White | 411/360 |
| 1,638,282 | A * | 8/1927 | Wood | 24/130 |
| 3,055,100 | A * | 9/1962 | Kimpel | 29/520 |
| 3,112,547 | A * | 12/1963 | Poe | 411/80.2 |
| 3,486,495 | A | 12/1969 | Allen | |
| 3,548,704 | A * | 12/1970 | Kutryk | 411/373 |
| 4,064,862 | A * | 12/1977 | Groner | 124/25.6 |
| RE30,445 | E * | 12/1980 | Ruhl | 411/361 |
| 4,917,070 | A * | 4/1990 | Townsend | 124/23.1 |
| 5,211,155 | A * | 5/1993 | Zamojski | 124/25.6 |
| 5,368,006 | A | 11/1994 | McPherson | |
| 5,373,959 | A * | 12/1994 | Haasewinkel | 220/324 |
| 5,425,286 | A * | 6/1995 | Laue | 74/560 |
| 5,429,014 | A * | 7/1995 | Laue | 74/586 |
| 5,636,956 | A * | 6/1997 | Emmett et al. | 411/360 |
| 5,649,522 | A | 7/1997 | Troncoso | |
| 5,672,036 | A * | 9/1997 | Medal | 411/82 |
| 6,082,347 | A | 7/2000 | Darlington | |
| 6,119,306 | A * | 9/2000 | Antonucci et al. | 16/86 A |
| 6,145,208 | A | 11/2000 | Savage | |
| 6,415,780 | B1 * | 7/2002 | Proctor | 124/25.6 |
| 6,474,324 | B1 * | 11/2002 | Despart et al. | 124/25.6 |
| 6,537,006 | B1 * | 3/2003 | Clark | 411/82 |
| 7,305,979 | B1 | 12/2007 | Yehle | |
| 7,637,256 | B2 * | 12/2009 | Lee | 124/25.6 |
| 2007/0193568 | A1 * | 8/2007 | Lee | 124/25.6 |
| 2010/0307471 | A1 * | 12/2010 | McPherson | 124/25.6 |
| 2011/0070049 | A1 * | 3/2011 | Wang | 411/372.6 |

OTHER PUBLICATIONS

Bullet Design-Secant Vs. Tangent Ogive; http"//accurateshooter.wordpress.com/2007/07/10/283/; Jul. 10, 2007.
Corbin Swaged Bullet Designs; http://www.corbins.com/design.htm; Retrieved Jul. 22, 2009.
Priority Document: U.S. Appl. No. 61/115,489, filed Nov. 17, 2008; inventor Mathew A. McPherson.
http://en.wikipedia.org/wiki/Ogive, retrieved Jul. 22, 2009.

* cited by examiner

*Primary Examiner* — Gene Kim
*Assistant Examiner* — John E Simms, Jr.
(74) *Attorney, Agent, or Firm* — Vidas, Arrett & Steinkraus

(57) ABSTRACT

In some embodiments, an archery bow axle comprises a first portion and a second portion. The second portion is configured for fixed attachment to said first portion in one of a plurality of positions. The axle will have a different length in each of the positions. In some embodiments, an axle comprises a shaft and an end cap having a cavity, wherein a portion of the shaft is received in the cavity.

19 Claims, 4 Drawing Sheets

ARCHERY BOW AXLE

CROSS-REFERENCE TO RELATED APPLICATIONS

This application claims the benefit of U.S. Provisional Application No. 61/115,489, filed Nov. 12, 2008, the entire contents of which is hereby incorporated herein by reference.

BACKGROUND OF THE INVENTION

This invention relates generally to archery bows and more specifically to an axle for use with archery bows.

Archery bows having "split limbs" are generally known in the art. Such bows typically include an axle extending between two split-limb portions. The axle can support rotatable member such as a cam, pulley, etc. Some examples of archery bows are disclosed in U.S. Pat. Nos. 5,368,006, 6,082,347, 7,305,979 and U.S. patent application Ser. No. 12/248,467, the entire disclosures of which are hereby incorporated herein by reference.

Prior art axles generally have a predetermined length and a single groove at each end. Each groove accepts a clip, typically a spring tension clip having an E-configuration. The E-clips lock onto the axle grooves and abut the outer sides of the split-limb portions, thereby locking the axle to the limb.

This method of mounting the axle has been relatively secure, but due to variances and tolerances that exist in the manufacture of bow limbs and axles, a number of undesirable problems can arise. Variance in the width of limbs causes a need for slightly different axle lengths to ensure proper fit. This results in a need for multiple axle lengths and/or different spacer components to be on hand, as well as unpredictability as to the specific parts that will be used. In some instances, a spring clip may lock onto an axle groove to prevent lateral movement as required, but there may be a loose radial fit between the groove and the clip. This can result in buzzing noises as the clip vibrates against the axle and/or the limb, especially if there is any degree of lateral clearance between the clips and the outer edges of the bow limbs.

Prior art E-clips further require special tools for attachment and removal, for example during servicing.

There remains a need for adjustable-length archery bow limb axles. There further remains a need for an axle arrangement that can be serviced without using tools.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow axle comprises a first portion and a second portion. The second portion is configured for fixed attachment to said first portion in one of a plurality of positions. The axle will have a different length in each of the positions.

In some embodiments, an archery bow axle comprises a shaft and an end cap defining a cavity. The shaft is attached to the end cap and a portion of the shaft is oriented in the cavity.

In some embodiments, a method comprises providing a shaft and an end cap that defines an internal cavity. An end of the shaft is inserted into the cavity to form an archery bow axle of desired length. In some embodiments, the length of the axle can be adjusted by moving the shaft with respect to the end cap.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
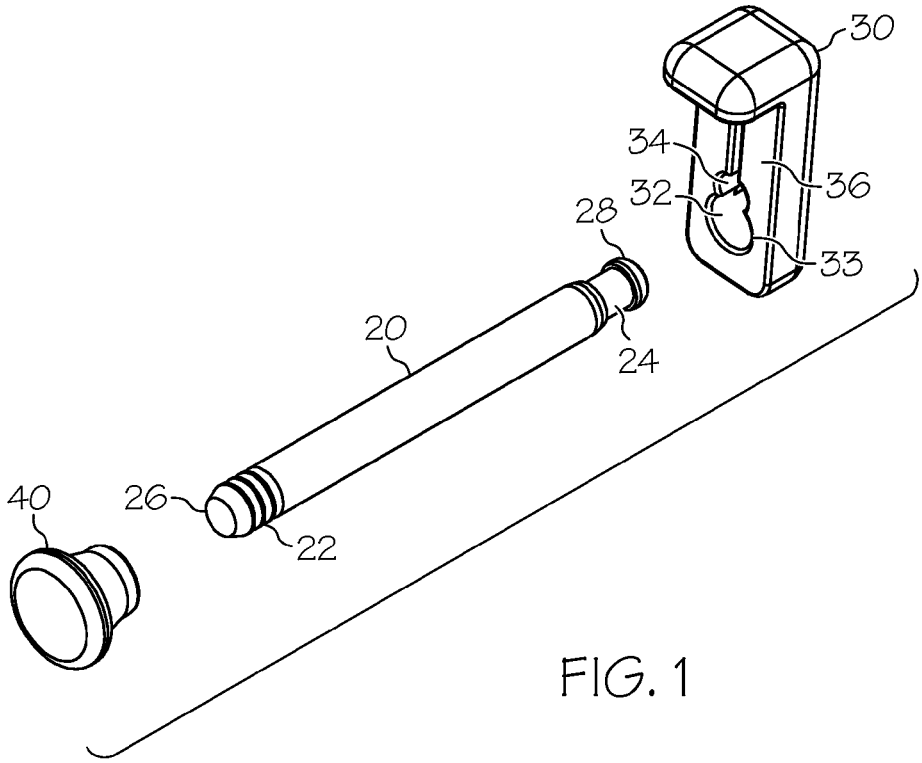
FIGS. 1-3 show exploded views of an embodiment of a shaft, a cap and a retainer.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the Figures shall refer to like features unless otherwise indicated.

An archery bow axle comprising a first portion engaged to a second portion allows for adjustment of the axle length. In some embodiments, the first portion overlaps the second portion along the length of the axle, and adjustment of the amount of overlap will adjust the axle length.

Figure 2:
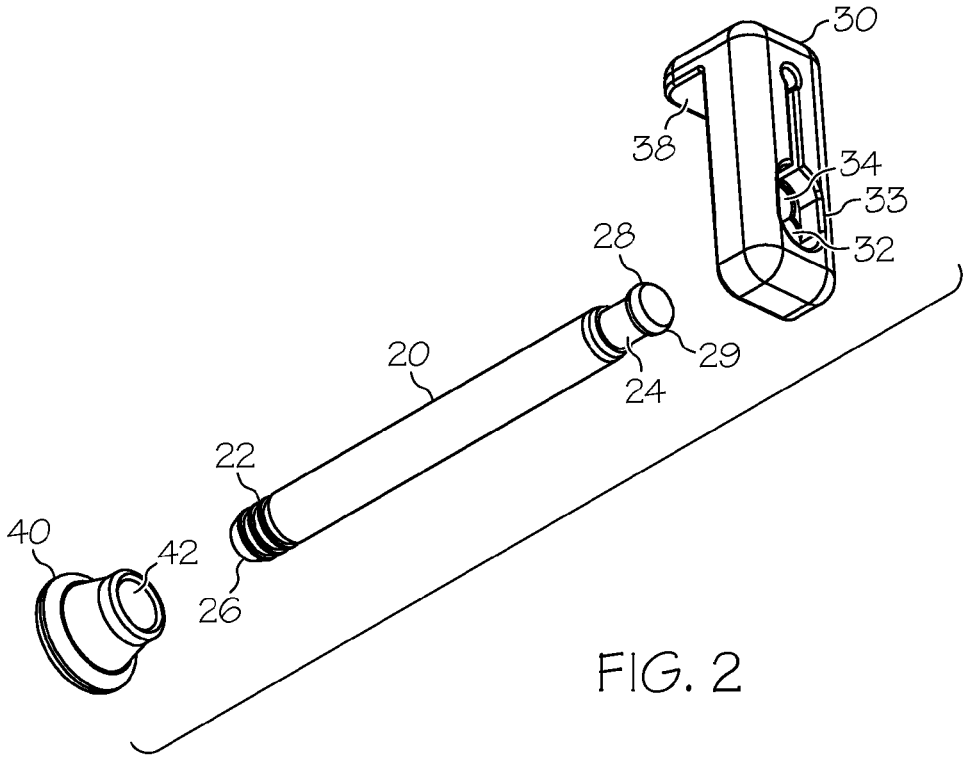
Figure 3:
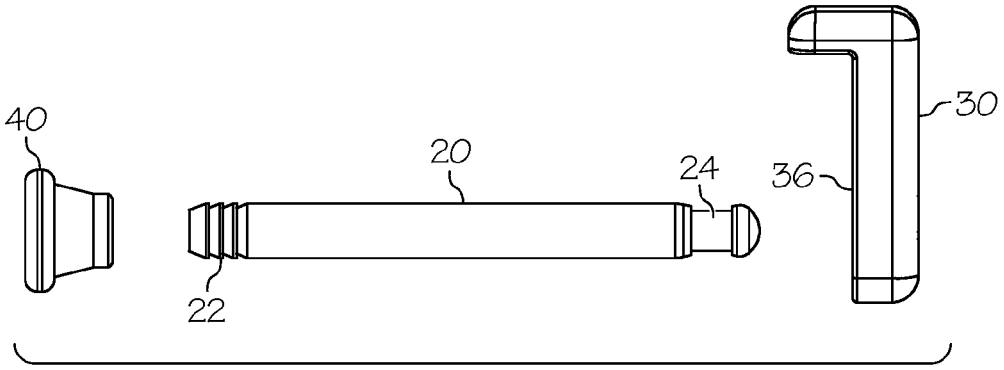

FIGS. 1-3 show exploded views of an embodiment of an archery bow axle comprising a shaft 20 configured for attachment to a cap 40, and a retainer 30. In some embodiments, a first end portion 26 of the shaft 20 is configured for an adjustable engagement with the cap 40. In some embodiments, a second end portion 28 of the shaft 20 is configured for a quick release engagement with a suitably configured retainer 30.

The adjustable engagement between the first end portion 26 and the cap 40 allows for adjustability of the specific distance d (see FIG. 5) between the cap 40 and the retainer 30 when the device is assembled. The specific distance d can be considered the effective interior length of the axle. For example, the adjustable engagement allows for varying amounts of overlap between the shaft 20 and the cap 40 along the length of the axle.

In some embodiments, the second end 28 of the shaft 20 comprises an engagement region 24, such as a groove having a smaller diameter. The retainer 30 comprises an engaging surface 34 sized to engage the engagement region 24. The retainer 30 is desirably configured for a snap fit engagement that allows the retainer 30 to be attached and/or detached without using tools. In some embodiments, a depth of the engaging surface 34 is approximately equal to the lengthwise span of the engagement region 24.

In some embodiments, a wall portion 36 of the retainer 30 comprises a shaped aperture 32. At least a portion of the aperture 32 is defined by the engaging surface 34. In some embodiments, the engaging surface 34 is semicircular and sized similarly to the groove 24 in the shaft 20. In some embodiments, the aperture 32 comprises a receiving portion 33 sized to temporarily receive the shaft 20. In some embodiments, the receiving portion 33 is semicircular, and a diameter of the receiving portion 33 is greater than an outer diameter of the shaft 20 at the second end portion 28, for example an outer diameter of a second end flange 29. In some embodiments, the engaging surface 34 and the receiving portion 33 define the aperture 32 to have a figure-eight shape, wherein a distance across the receiving portion 33 is greater than a distance across the engaging surface 34.

In some embodiments, the retainer 30 further comprises a flange 38 that is shaped to abut an end of an archery bow limb when the retainer is installed in the archery bow. In some embodiments, a surface of the flange 38 is oriented at an angle to the wall portion 36. In some embodiments, the flange 38 is orthogonal to the wall portion 36.

In some embodiments, the first end portion 26 of the shaft 20 is configured to adjustably engage the cap 40. For example, the shaft 20 and cap 40 can be configured for a fixed attachment at one of several potential orientations/positions, wherein each position provides for a different overall length of the axle assembly. Desirably, the specific engagement position between first end portion 26 and the cap 40 will be set during initial assembly of the device, and that specific orientation will be retained for the life of the device.

The shaft 20 can be engaged to the cap 40 using any suitable method. In some embodiments, the engagement can be substantially permanent, for example using adhesives, crimping, soldering or other methods that are generally considered permanent. In some embodiments, the engagement can allow for readjustment of the length of the axle, for example by using a friction or interference fit. Desirably, a friction fit between the shaft 20 and cap 40 will not allow the shaft 20 to move with respect to the cap 40 under any loading conditions experienced when the axle is used in a bow; however, a technician will be able to adjust the length by specifically applying forces to the shaft 20 and/or cap 40.

In some embodiments, the cap 40 comprises a cavity 42 shaped to receive the first end portion 26 of the shaft 20. The depth that the shaft 20 is received in the cavity impacts length of the axle assembly. In some embodiments, the cavity 42 comprises a cylindrical inner surface. In some embodiments, the cavity 42 is sized to frictionally engage the first end portion 26 of the shaft 20 (e.g. interference fit).

Figure 4:
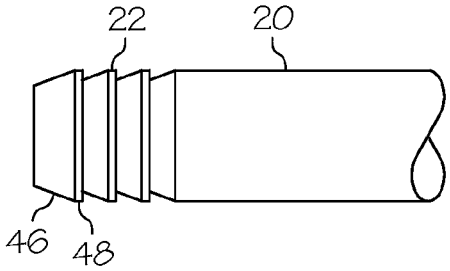
FIG. 4 shows an end of an embodiment of a shaft.

The first end portion 26 of the shaft 20 is desirably shaped to engage the cap 40. In some embodiments, the first end portion 26 of the shaft 20 comprises a plurality of barb serrations 22. For example, as shown more clearly in FIG. 4, each barb serration 22 can comprise a frustoconical portion 46 and an abutting outer portion 48. In some embodiments, each frustoconical portion 46 slopes away from the body of the shaft 20. This configuration encourages the barb serrations 22 to enter the cavity 42 of the cap 40 and resist backing out. The abutting outer portions 48 are desirably sized to frictionally engage the inner surface of the cavity 42.

The first end portion 26 of the shaft 20 is configured to engage the cap 40 over a range of travel. Although a single serration 22 is capable of securely engaging the cavity 42, the cavity 42 desirably has a depth capable of receiving multiple serrations 22. Thus, the shaft 20 and the cap 40 can engage one another at many different orientations, with the range being infinitely adjustable.

Figure 5:
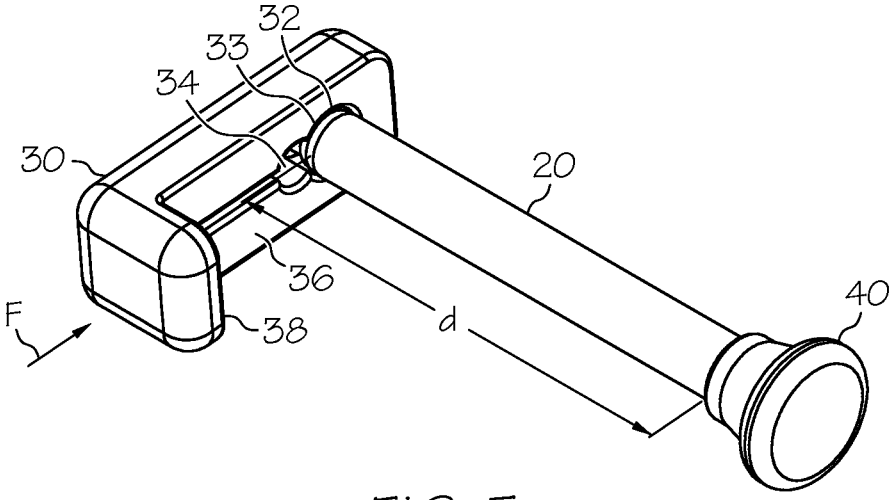
FIG. 5 shows a partially assembled view of an embodiment of a shaft, a cap and a retainer.
Figure 6:
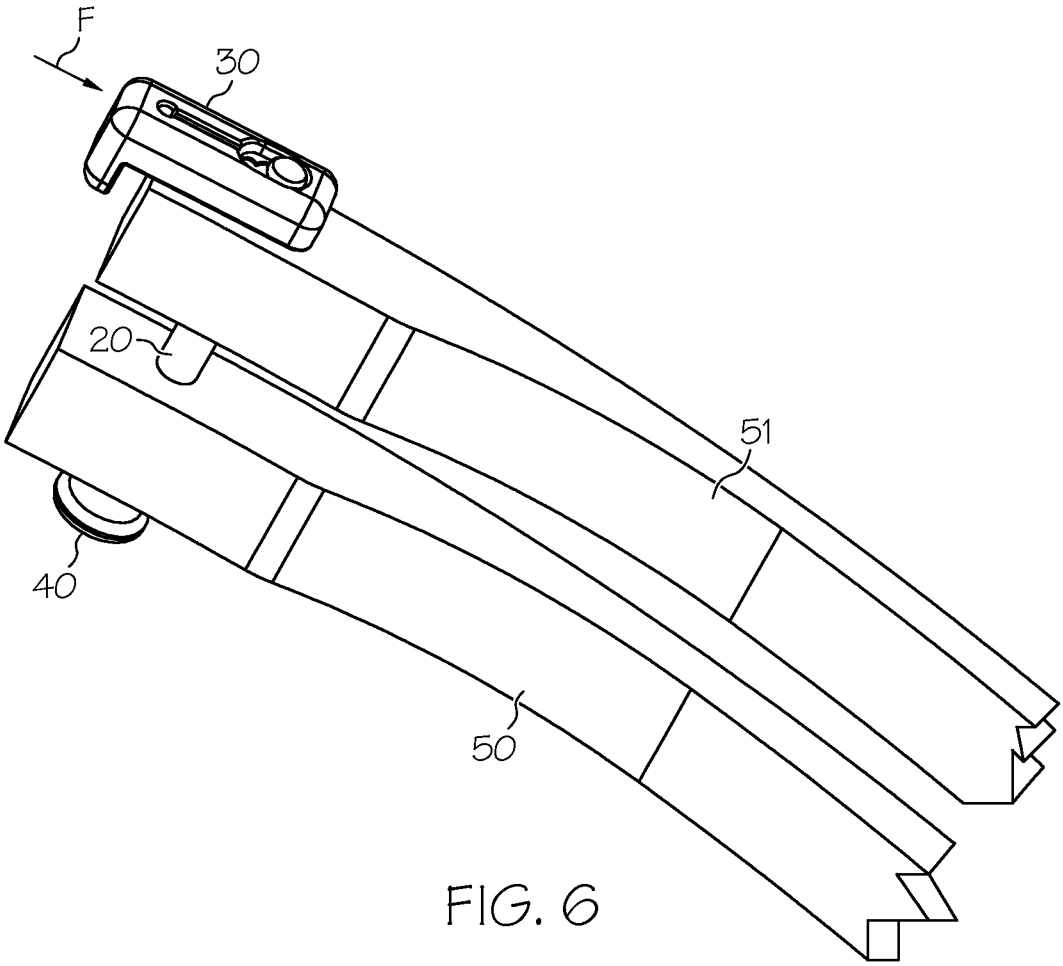
FIG. 6 shows a partially assembled view of an embodiment of a shaft, a cap and a retainer oriented on a bow limb.

FIG. 5 shows an embodiment of a shaft 20, a cap 40 and a retainer 30 partially assembled. Adjustment of the engagement orientation between the shaft 20 and the cap 40 adjusts the distance d between limb abutting surfaces of the cap 40 and the retainer 30. The distance d can be considered the effective interior length of the axle. FIG. 6 shows an embodiment of a shaft 20, a cap 40 and a retainer 30 partially assembled and installed with bow limb portions 50, 51. The effective interior length d of the axle can be set according to a width of the limb, or distance between outer sides of bow limb portions 50, 51.

In some embodiments, the shaft 20 and the cap 40 are attached to one another in a pre-assembly fixture, such as a press, wherein the first end portion 26 of the shaft 20 is pressed into the cavity 42 of the cap 40 to a preset gauged distance that results in the desired dimension d. The dimension d can be determined, for example, by measuring the specific limb portions 50, 51 that will be used with the shaft 20.

Although an embodiment configured for a press-fit between the shaft 20 and cap 40 using barbs is illustrated herein, any suitable adjustable engagement method can be used. In some embodiments, the first end portion 26 of the shaft 20 comprises a knurled surface. In some embodiments, the first end portion 26 of the shaft 20 comprises a staked surface, for example having a plurality of raised radial stakes. In some embodiments, the first end portion 26 of the shaft 20 comprises a grooved surface, for example having a plurality of grooves. In some embodiments, the first end portion 26 is smooth and the cavity 42 is closely toleranced. In some embodiments, the first end portion 26 of the shaft 20 and the cavity 40 comprise complimentary threaded portions. The cap 40 is threaded onto the shaft 20 until the desired distance d is achieved, and a thread lock adhesive can be used to secure the cap 40 to the shaft 20. Any embodiment can further utilize an adhesive, epoxy or the like to further secure the cap 40 to the shaft 20.

Figure 7:
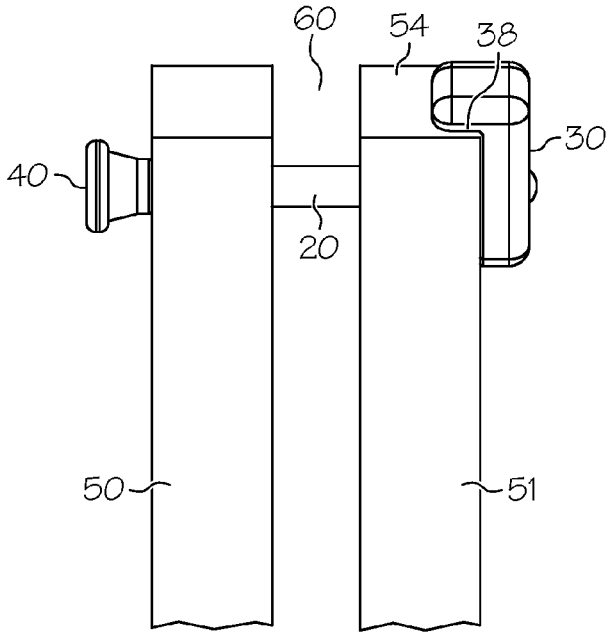
FIGS. 7 and 8 show assembled views of an embodiment of a shaft, a cap and a retainer oriented on a bow limb.
Figure 8:
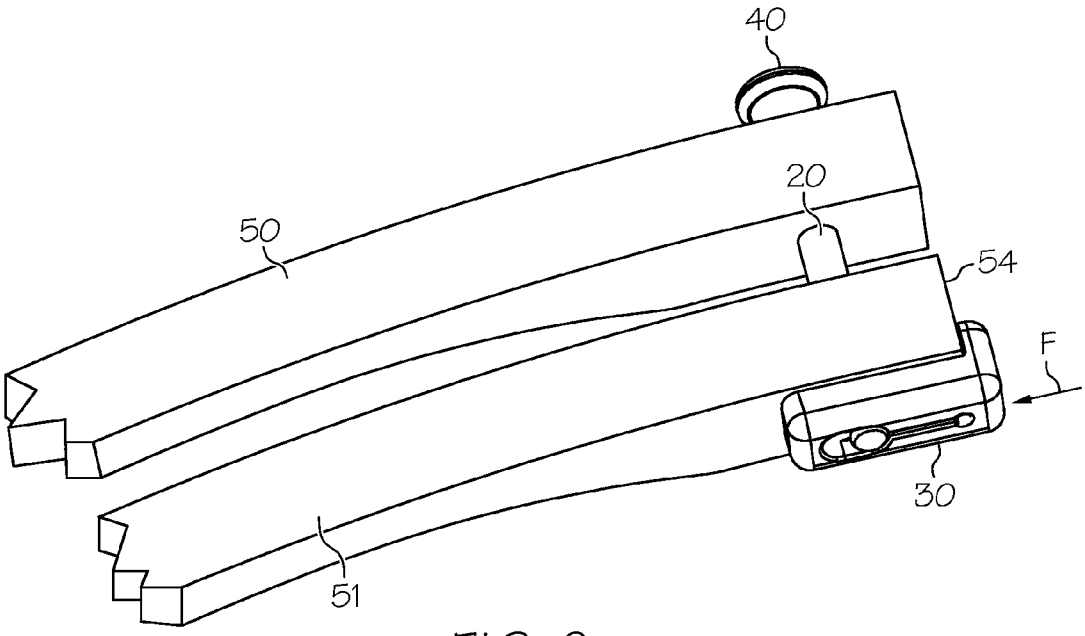

FIGS. 5 and 6 show the shaft 20 oriented in the receiving portion 33 of the aperture 32 of the retainer 30. A force F placed on the retainer will snap the shaft 20 into the engaging portion 34 of the retainer 30, locking the shaft 20 in place. FIGS. 7 and 8 show fully assembled views, wherein the cap 40 abuts an outer side surface of the first limb portion 50 and the wall portion 36 of the retainer 30 abuts an outer side surface of the second limb portion 51. The flange 38 of the retainer 30 further abuts an end portion 54 of the second limb portion 51. In some embodiments, the retainer 30 is shaped such that the transition between the wall portion 36 and the flange 38 matches the contour of the limb portion 51. Although the drawings illustrate right angles, various embodiments include curvature.

In some embodiments, the cap 40 comprises a conical shape, for example similar to a cabinet knob. This allows the cap 40 and attached shaft 20 to be grabbed by hand. In some embodiments, the cap 40 comprises a raised ridge, such as an annular ridge, that can function as a grip. Thus, the retainer 30 can be snapped on and off by hand, and the shaft 20/cap 40 assembly can further be removed by hand. The present axle arrangement allows for assembly and disassembly by hand, without the need for tools. This is desirable, for example, in the field when some servicing or repair is necessary and no tools are on hand.

In some embodiments, the second end 28 of the shaft 20 comprises a rounded end portion, which can lessen the difficulty of inserting the shaft through apertures in a limb The rounded end portion can comprise an ogive or bullet shape.

Although FIGS. 6-8 do not illustrate any rotatable members, it should be understood that the shaft 20 will typically support a rotatable member, such as a cam or pulley, which further supports one or more cables included in the archery bow.

In some embodiments, an axle assembly comprises a spacer (not shown), which can be used to set a particular length. For example, a spacer can be placed within the cavity of the cap 40 to limit the travel of the shaft 20 within the cavity. Thus, if multiple archery bow models that require different axle lengths are being built, a unique spacer can be for each model. Thus, common parts can be used across the model lines.

In some embodiments, the invention is directed to methods of making and using an adjustable axle as disclosed herein. A first portion 20 and second portion 40 of an axle can be provided. The first portion 20 is engaged to the second portion 40 in a desired orientation to form an axle having the desired length. The axle can then be used in an archery bow.

In some embodiments, a pressing device can be used to force a shaft 20 end portion into a cap 40 cavity. A pressing device can be arranged to press the axle assembly to a predetermined length.

In some embodiments, a previously assembled axle can be adjusted by moving the first portion 20 with respect to the second portion 40 to adjust the axle length. This can allow for fine adjustment of tolerances between bow parts proximate to the axle. Further, adjustment of axle length can allow a given axle to be re-used in a different bow that requires a different axle length.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow axle comprising:

a shaft comprising a first end portion and a second end portion, said shaft having sufficient strength to be used as an axle in an archery bow; and an end cap defining a cavity;

wherein the shaft first end portion is attached to the end cap and a portion of the shaft is oriented in the cavity, said shaft first end portion comprising barb serrations, an amount of overlap between the shaft and the end cap adjustable to adjust an effective interior length of the archery bow axle; said bow axle further comprising a retainer configured for snap fit attachment to said shaft second end portion.

2. The archery bow axle of claim 1, wherein said shaft is attached to said end cap via an interference fit.

3. The archery bow axle of claim 1, wherein a cross-sectional shape of said cavity is similar to a cross-sectional shape of a barb serration.

4. The archery bow axle of claim 1, said cap comprising a raised ridge.

5. The archery bow axle of claim 1, wherein said shaft comprises a rounded end portion.

6. The archery bow axle of claim 1, wherein each barb serration comprises a frustoconical portion, each frustoconical portion decreasing in size as the frustoconical portion is traversed along an axis of said shaft in a direction away from said second end portion.

7. The archery bow axle of claim 6, wherein a barb serration comprises a cylindrical portion.

8. The archery bow axle of claim 7, wherein said cylindrical portion comprises a diameter similar to a diameter of a midportion of said shaft.

9. The archery bow axle of claim 1, said shaft comprising a groove.

10. The archery bow axle of claim 1, said retainer comprising a wall portion and a flange portion oriented orthogonal to the wall portion.

11. The archery bow axle of claim 1, said retainer comprising an aperture arranged to engage said shaft.

12. The archery bow axle of claim 11, said aperture comprising a first portion and a second portion, the second portion being larger than the first portion.

13. The archery bow axle of claim 11, wherein said aperture comprises a figure-eight shape.

14. An archery bow comprising:

a limb;

an axle comprising:

a first portion;

a second portion and a retainer; said second portion configured for fixed attachment to said first portion in one of a plurality of positions, said axle having a different effective interior length in each position; said first portion comprising a shaft having a first end portion and a second end portion, said first end portion comprising a plurality of barb serrations, each barb serration comprising a sloped portion, each sloped portion decreasing in size as the sloped portion is traversed along an axis of said shaft in a direction away from said second end portion, and said second portion comprising and end cap having a cavity, at least a portion of said shaft first end portion oriented in said cavity, a depth of said shaft within said cavity being different for each position; said retainer configured for snap fit attachment to said shaft second end portion;

said axle supported by said limb.

15. A method comprising:

providing a shaft having a first end portion and a second end portion and an end cap, the end cap defining a cavity, the shaft attachable to said end cap at a plurality of predetermined depths, each predetermined depth providing for a different effective interior axle length; providing a retainer configured for snap fit attachment to said shaft second end portion;

inserting said first end portion of said shaft into said cavity to one of said predetermined depths to form an archery bow axle of desired length;

providing an archery bow limb;

attaching said archery bow axle to said archery bow limb attaching said retainer to said second end portion.

16. The method of claim 15, further comprising increasing a depth of said shaft in said cavity to reduce the length of the axle.

17. The method of claim 15, further comprising using a press to force said shaft into said cavity.

18. An archery bow axle comprising:

a shaft having a first end and a second end, said shaft having sufficient strength to be used as an axle in an archery bow; said shaft first end comprising barb serrations;

an end cap fixedly attached to said shaft, said end cap defining a cavity, said first end of said shaft oriented within said cavity; and a retainer attached to said second end of said shaft;

wherein said shaft and said end cap are configured for fixed attachment to one another at one of a plurality of orientations to adjust an amount of overlap between the shaft and the end cap, wherein adjustment of said amount of overlap adjusts a distance between said end cap and said retainer.

19. The archery bow axle of claim 18, consisting of said shaft, said end cap and said retainer.

* * * * *